US005668339A

United States Patent [19]

Shin

[11] Patent Number: 5,668,339

[45] Date of Patent: Sep. 16, 1997

[54] APPARATUS FOR MULTIPLEXING AN AUDIO SIGNAL IN A VIDEO-SONG PLAYBACK SYSTEM

[75] Inventor: Jae-Sung Shin, Seoul, Rep. of Korea

[73] Assignee: Daewoo Electronics Co., Ltd., Seoul, Rep. of Korea

[21] Appl. No.: 548,552

[22] Filed: Oct. 26, 1995

[30] Foreign Application Priority Data

Oct. 26, 1994 [KR] Rep. of Korea ..... 94-27347
Oct. 26, 1994 [KR] Rep. of Korea ..... 94-27348

[51] Int. Cl.[6] ..... G10H 1/00; G10H 7/00

[52] U.S. Cl. ..... 84/634; 84/609; 84/DIG. 27; 381/28; 381/123

[58] Field of Search ..... 84/617, 655, DIG. 27, 84/601, 602, 609–614, 634–638, 477 R; 381/61, 63, 28, 118, 120, 123

[56] References Cited

U.S. PATENT DOCUMENTS 5,126,981 6/1992 Kim ..... 369/2
5,343,534 8/1994 Dorrough et al. ..... 381/123
5,428,184 6/1995 Park ..... 84/609
5,510,573 4/1996 Cho et al. ..... 84/610

*Primary Examiner*—Jonathan Wysocki
*Assistant Examiner*—Marlon Fletcher
*Attorney, Agent, or Firm*—Fish & Richardson, P.C.

[57] ABSTRACT

An apparatus for multiplexing audio signals in a disc-shaped video-song medium which includes a plurality of digital audio channels having stereo accompaniment music recorded therein, and a plurality of analog channels having stereo accompaniment music which includes a singer's singing voice, and playback system thereof, are disclosed. When the video-song mode is established, the apparatus for multiplexing the audio signals adjusts the audio levels of both the stereo accompaniment music and the stereo accompaniment music that includes a singer's singing voice to adequate audio levels by means of an audio level adjustment responsive to a change in the resistances in the variable resistors included in an audio multiplexing section. The apparatus multiplexes the audio signals. Accordingly, the user can effectively practice a video-song in harmony with either the stereo accompaniment music or the stereo accompaniment music that includes a singer's singing voice.

5 Claims, 3 Drawing Sheets

APPARATUS FOR MULTIPLEXING AN AUDIO SIGNAL IN A VIDEO-SONG PLAYBACK SYSTEM

BACKGROUND OF THE INVENTION

1. Field of the Invention

The present invention relates to a musical accompaniment playing apparatus called "KARAOKE" equipment. More particularly, the present invention relates to an apparatus for multiplexing an audio signal in a video-song playback system that selectively outputs either a stereo accompaniment music or a stereo accompaniment music that includes a singer's singing voice.

2. Description of the Prior Art

At present, musical accompaniment playing apparatuses, in which one or more singers practice singing a song while looking at the words to the song's text displayed on a display screen of a display, and while being accompanied by a prerecorded music, are widespread. These musical accompaniment playing apparatuses include compact disc graphics (CDG) discs that have word data to songs, accompaniment music and graphic information recorded thereon; or disc type audio/video information recording media on which information, e.g., word data to songs, accompaniment music and moving video signals, can be massively recorded. Hereinafter, CDG discs and disc type audio/video information recording media and playback systems will be respectively designated as "video-song media" and "video-song playback systems". Each of the video-song playback systems includes an audio/video playback equipment in which a video-song medium is loaded and information, e.g., word data to songs, accompaniment music, and moving video signals, is reproduced from the loaded video-song medium. The audio/video playback equipment is operatively coupled with control equipment and with display equipment, such as a television set. The audio/video playback equipment may comprise a stand-alone-equipment or may be integrated with the control equipment. An audio amplifier is operatively coupled with the control equipment.

In the aforementioned video-song playback system, when a singer's singing voice is inputted into a voice input device, such as a microphone, in response to the song's words dam and to the accompaniment music which are reproduced from a CDG disc or a laser disc, the inputted singing voice is converted into an electrical signal. The electrical signal is amplified via an amplifier and filtered through a low pass filter, and then passes through a speaker in order to be outputted therefrom. Also, each of the video-song playback systems functions to adjust a musical interval of the accompaniment music of a selected video-song in order to double the singer's interest while practicing a video-song. Furthermore, in the video-song playback systems, while a pair of signal level detectors functions to detect the respective signal levels of both the singer's singing voice and the accompaniment music with a predetermined time interval, the signal level detectors are synchronized with each other. A microprocessor then sums up the difference in the computed signal level between the two signals until the singer's singing of a song is finished, and then a score display device displays the singing score of the singer.

As an example of the aforementioned video-song playback systems, U.S. Pat. No. 5,296,643 (issued to Jen-Wei Kuo and Tat N. Ho) discloses the configuration of a KARAOKE device that uses an automatic musical key adjustment system.

FIG. 1 is a schematic diagram for showing an example of a recording format of an audio signal on a video-song recording medium. As shown in FIG. 1, the video-song medium includes a plurality of digital audio channels and a plurality of analog audio channels. The plurality of the digital audio channels has stereo accompaniment music recorded thereon. The plurality of the analog channels includes L and R channels. The L channel has accompaniment music recorded therein and the R channel has accompaniment music including a singer's singing voice recorded therein. Therefore, playback of the accompaniment music is performed by the digital audio channels, and practice of a video-song by multiplexing of an audio signal is performed while audio levels of both the accompaniment music and the accompaniment music including a singer's singing voice recorded in the analog audio channels are adjusted in an adequate ratio in order to reproduce either the accompaniment music or the accompaniment music including a singer's singing voice.

FIG. 2 is a schematic diagram for showing another example of a recording format of an audio signal in a video-song medium. As shown in this figure, the video-song medium includes a plurality of digital audio channels and a plurality of analog audio channels. The plurality of the digital audio channels includes L channel and R channel, and the plurality of the analog audio channels also includes L and R channels. A plurality of the digital audio channels has stereo accompaniment music recorded therein, and a plurality of the analog channels has stereo accompaniment music including a singer's singing voice recorded therein. Therefore, since the L channel and the R channel have the stereo accompaniment music and the singer's singing voice recorded therein in a mixed manner, the user cannot practice a video-song in harmony either with a reproduced stereo accompaniment music or with a reproduced singer's singing voice.

SUMMARY OF THE INVENTION

Therefore, it is an object of the present invention to provide an apparatus for multiplexing an audio signal for adjusting the audio levels of both a digital audio signal and an analog audio signal, in order to selectively output a stereo accompaniment music or a stereo accompaniment music including a singer's singing voice while setting up a video-song mode in a video-song playback system and in a disc-shaped video-song medium, in which digital audio channels have stereo accompaniment music recorded therein and analog audio channels have stereo accompaniment music including a singer's singing voice.

In order to achieve the above object, according to one embodiment, the present invention provides an apparatus for multiplexing an audio signal in a video-song playback system, which comprises:

a digital signal processing section for processing a first stereo accompaniment music read out from an L and an R channels, included in digital audio channels of the video-song medium, into digital audio signals, to output a first and a second digital audio signals, the video-song medium having both the digital audio channels with the first stereo accompaniment music recorded therein and analog audio channels with a second stereo accompaniment music including a singer's singing voice;

an analog signal processing section for processing the second stereo accompaniment music read out from the L and the R channels, included in the analog audio channels of the video-song medium, into analog audio signals to output a first and a second analog audio signals;

a first switching section for switching over between the first digital audio signal from the digital signal processing section and the first analog audio signal from the analog signal processing section to output a first switched signal;

a second switching section for switching over between the second digital audio signal from the digital signal processing section and the second analog audio signal from the analog signal processing section to output a second switched signal;

an audio multiplexing section for adjusting audio levels of the first and the second digital audio signals from the digital signal processing section, the first switched signal from the first switching section and the second switched signal from the second switching section, in an analog mode and an video-song mode, to output a first and a second multiplexed signals;

first and second amplifying sections for amplifying the first and the second multiplexed signals to output a first and a second amplified signals;

a first mode switching section for switching between the first switched signal from the first switching section and the first amplified signal from the first amplifying section in order to switch between a normal playback mode and a video-song mode to output a first mode switched signal;

a second mode switching section for switching between the second switched signal from the second switching section and the second amplified signal from the second amplifying section in order to switch between the normal playback mode and the video-song mode to output a second mode switched signal;

a third amplifying section for amplifying the first mode switched signal from the first mode switching section to output a third amplified signal;

a fourth amplifying section for amplifying the second mode switched signal from the second mode switching section to output a fourth amplified signal; and a control section for sensing whether a selected mode is the normal playback mode or the video-song mode to control the first and the second switching sections and the first and the second mode switching sections.

The audio multiplexing section preferably includes a variable resistor having two resistors comprised of a first and a second variable resistors and one adjusting knob, in which the resistances of the two resistors are adjusted by a user in contrast to each other. When the analog mode and the video-song mode are established, the first and the second digital audio signals from the digital signal processing section are applied to the first variable resistor, and the first and the second switched signals from the first and the second switching sections are applied to the second variable resistor so that the audio multiplexing section may adjust the signal levels of the stereo accompaniment music and stereo accompaniment music including a singer's singing voice in proportion to the resistances of the first and the second variable resistors.

In order to achieve the above object, the present invention, according to another embodiment, provides an apparatus for multiplexing an audio signal in a video-song playback system, which comprises:

a digital signal processing section for processing a first stereo accompaniment music read out from an L and an R channels included in digital audio channels of a video-song medium, into digital audio signals to output a first and a second digital audio signal, the video-song medium having both the digital audio channels with the first stereo accompaniment music recorded therein and analog audio channels with a second stereo accompaniment music including a singer's singing voice;

an analog signal processing section for processing the second stereo accompaniment music read out from the L and the R channels, included in the analog audio channels of the video-song medium, into analog audio signals to output a first and a second analog audio signals;

a first switching section for switching over between the first digital audio signal from the digital signal processing section and the first analog audio signal from the analog signal processing section, to output a first switched signal;

a second switching section for switching over between the second digital audio signal from the digital signal processing section and the second analog audio signal from the analog signal processing section, to output a second switched signal;

an audio multiplexing section for adjusting audio levels of the first and the second digital audio signals from the digital signal processing section, the first switched signal from the first switching section and the second switched signal from the second switching section in a digital mode and a video-song mode, to output a first, a second and a third multiplexed signals;

a first and a second amplifying sections for amplifying the first and the second multiplexed signals to output a first and a second amplified signals, respectively;

a second mode switchover section for switching over between the first switched signal from the second switching section and the first amplified signal from the first amplifying section, in order to switch over between a normal playback mode and a video-song mode, to output a first mode switchover signal, the first mode switchover section switching over from the normal playback mode to the video-song mode when a voice input device is connected to the video-song playback system in order to perform the video-song mode;

a second mode switchover section for switching over between the second switched signal from the second switching section and the first amplified signal provided by the first amplifying section in order to switch over between the normal playback mode and the video-song mode, to output a second mode switchover signal, the second mode switchover section switching over from the normal playback mode to the video-song mode when a voice input device is connected to the video-song playback system in order to perform the video-song mode;

a third amplifying section for amplifying the first mode switchover signal from the first mode switchover section, to output a third amplified signal;

a fourth amplifying section for amplifying the second mode switchover signal from the second mode switchover section, to output a fourth amplified signal; and a third switching section for switching over the first and the second analog audio signals from the analog signal processing section, to output a third switched signal;

a fifth amplifying section for amplifying the third switched signal from the third switching section, to output a fifth and a sixth amplified signals, where the fifth amplifying section is connected to the third and the fourth amplifying sections so that outputs of the fifth and the sixth amplified signals may be inputted to the third and the fourth amplifying sections;

a control section for sensing whether a selected mode is the normal playback mode or the video-song mode to control switching operation of the first and the second switching sections, and for detecting audio levels of the first and the second analog audio signals, which are adjusted by the audio multiplexing section to control voltage levels of the fifth and the sixth amplified signals from the fifth amplifying section.

The audio multiplexing section preferably includes a variable resistor having three variable resistor comprised of a first, a second and a third variable resistors and an adjusting knob in which the resistances are adjusted by a user in contrast to each other. When the digital mode and the video-song mode are established, the first and the second analog signals from the analog signal processing section are applied to the first variable resistor, and the first and the second switched signals from the first and the second switching sections are applied to the second variable resistor, so that the audio multiplexing section adjusts audio signal levels of stereo accompaniment music and stereo accompaniment music including a singer's singing voice in proportion to the resistances of the first and the second variable resistors. Preferably, if the control section detects by the third multiplexed signal from the third variable resistor included in the audio multiplexing section that the resistance of the first variable resistor is adjusted to its maximum value, then the control section applies a control signal to the fifth amplifying section so that the audio levels of the fifth and the sixth amplified signals provided by the fifth amplifying section are decreased.

Therefore, in a video-song playback system for reproducing the disc-shaped video-song medium having the stereo accompaniment music recorded in a plurality of the digital audio channels therein and the stereo accompaniment music including a singer's singing voice recorded in a plurality of the analog audio channels therein, when the video-song mode is established, the control section and the audio multiplexing section adjust the audio levels of the digital audio signal and the analog audio signal in order to selectively output either the stereo accompaniment music or the stereo accompaniment music that includes a singer's singing voice.

BRIEF DESCRIPTION OF THE DRAWINGS

The above object and other advantages of the present invention will become more apparent by describing in detail the preferred embodiment of the present invention with reference to the attached drawings, in which.

DESCRIPTION OF THE PREFERRED EMBODIMENTS

A description will be given below in detail to the configurations and operations of apparatuses for multiplexing audio signals in a video-song playback system according to embodiments of the present invention with reference to the accompanying drawings.

Embodiment 1

Figure 1:
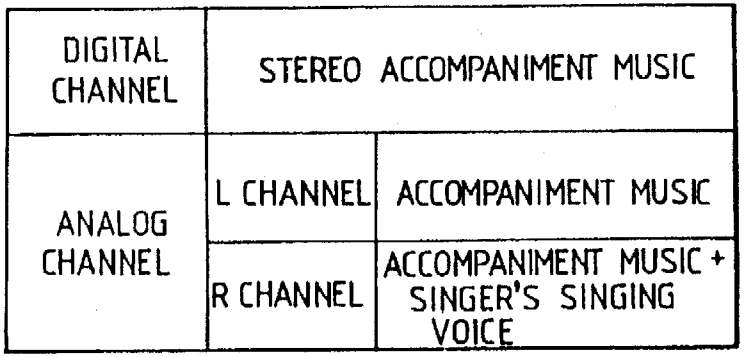
FIG. 1 is a schematic diagram for showing an example of recording formats of audio signals in a video-song medium.
Figure 2:
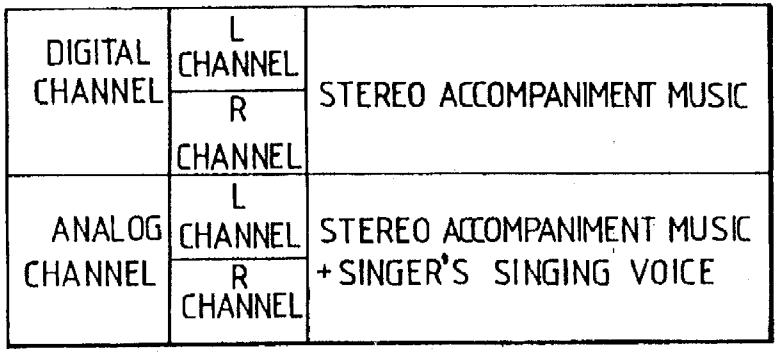
FIG. 2 is a schematic diagram for showing another example of recording formats of audio signals in a video-song medium.
Figure 3:
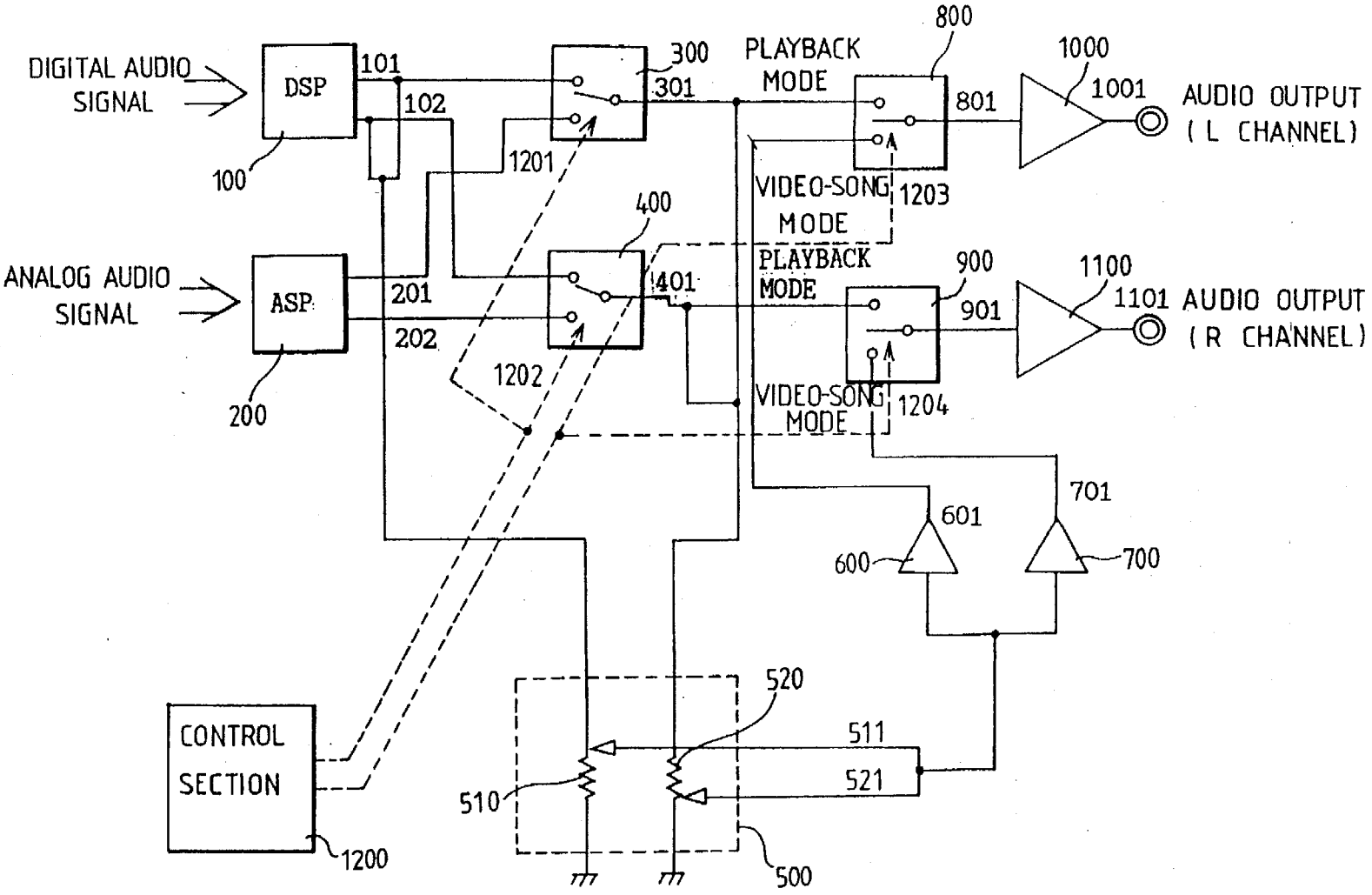
FIG. 3 is a block diagram for showing a configuration of one embodiment of an apparatus for multiplexing audio signals in a video-song playback system for reproducing the video-song medium shown in FIG. 2.

As shown in FIG. 2, the disc-shaped video-song medium includes both digital audio channels that have the first stereo accompaniment music recorded therein and analog audio channels that have the second stereo accompaniment music that includes a singer's singing voice recorded therein. FIG. 3 is a block diagram for showing a configuration of one embodiment of an apparatus for multiplexing audio signals in a video-song playback system for reproducing the video-song medium shown in FIG. 2. As shown in FIG. 3, the apparatus for multiplexing audio signals in a video-song playback system according to the first embodiment of the present invention includes a digital signal processing section 100. Digital signal processing section 100 decodes the first stereo accompaniment music, which is read out from the L and the R channels included in the digital audio channels in the disc-shaped video-song medium shown in FIG. 2, into digital audio signals and then outputs a first and a second digital audio signals 101 and 102 which respectively correspond to audio signals in the L and the R channels.

An analog signal processing section 200 decodes the second stereo accompaniment music that includes a singer's singing voice, which is read out from the L and the R channels included in the analog audio channels in the video-song medium, into analog audio signals, and then outputs a first and a second analog audio signals 201 and 202 which respectively correspond to audio signals in the L and the R channels.

A first switching section 300 switches over between first digital audio signal 101 from digital signal processing section 100 and first analog audio signal 201 from analog signal processing section 200. Consequently, first switching section 300 outputs a first switched signal 301 which corresponds either to first digital audio signal 101 or first analog audio signal 201.

A second switching section 400 switches over between second digital audio signal 102 from digital signal processing section 100 and second analog audio signal 202 from analog signal processing section 200. Consequently, second switching section 400 outputs a second switched signal 401 which corresponds either to second digital audio signal 102 or second analog audio signal 202.

In an analog mode and a video-song mode, an audio multiplexing section 500 adjusts the voltage levels of first and second digital audio signals 101 and 102 from digital signal processing section 100 and first and second switched signals 301 and 401 which are respectively provided by first and second switching sections 300 and 400, and then outputs a first and a second multiplexer signals 511 and 521. Audio multiplexing section 500 includes a variable resistor which has a first and a second variable resistors 510 and 520 and also includes an adjusting knob (not shown), and the resistances thereof are adjusted by a user in contrast to each other. When the user establishes the analog mode and the video-song mode, first and second digital audio signals 101 and 102 from digital signal processing section 100 are applied to first variable resistor 510 and first and second switched signals 301 and 401 from first and second switching sections are applied to second variable resistor 520. In this way, audio multiplexing section 500 adjusts signal levels of both the first stereo accompaniment music and the second stereo accompaniment music that includes a singer's singing voice in proportion to the resistances of first and second variable resistors 510 and 520. Consequently, the audio levels of first and second digital audio signals 101 and 102 applied to first variable resistor 510 and the audio levels of first and second switched signals 301 and 401 applied to second variable resistor 520 are adjusted in contrast to one another, so that the first stereo accompaniment music and the second stereo accompaniment music that includes a singer's singing voice are multiplexed.

A first and a second amplifying sections 600 and 700 respectively amplify first and second multiplexed signals 511 and 512 from audio multiplexing section 500 and respectively outputs a first and a second amplified signals 601 and 701.

A first mode switchover section 800 switches over between first switched signal 301 from first switching section 300 and first amplified signal 601 from first amplifying section 600 in order to switch over between a normal playback mode and video-song mode and then outputs a first mode switchover signal 801.

A second mode switchover section 900 switches over between second switched signal 401 from second switching section 400 and second amplified signal 701 from second amplifying section 700 in order to switch over between the normal playback mode and the video-song mode and then outputs a second mode switchover signal 901.

A third amplifying section 1000 amplifies first mode switchover signal 801 from first mode switchover section 800 and then outputs a third amplified signal 1001.

A fourth amplifying section 1100 amplifies second mode switchover signal 901 from second mode switchover section 900 and then outputs a fourth amplified signal 1101.

A control section 1200 provides first and second switching sections 300 and 400 with a first and a second switchover triggering signals 1201 and 1202 which respectively correspond to signals for selecting the digital mode and the analog mode which the user wants to establish. Also, in the normal playback mode, control section 1200 outputs the digital audio signals, and in video-song mode respectively provides first and second mode switchover section 800 and 900 with a first and a second mode switchover triggering signals 1203 and 1204 respectively so that audio multiplexing section 500 may output first and second multiplexed signals 511 and 521 in which audio levels thereof are adjusted. Namely, control section 1200 senses whether a selected mode is the normal playback mode or the video-song mode, and controls first and second switching sections 300 and 400 and first and second mode switchover sections 800 and 900 according to the selected modes.

Hereinafter, the operation of the apparatus for multiplexing audio signals in a video-song playback system according to embodiment 1 of the present invention having the above-mentioned configuration is described.

When the normal playback mode is selected along with the digital mode by a user, the operation is performed as follows. Under the control of control section 1200, first and second switching sections 300 and 400 are connectively switched over to the outputs for providing first and second digital audio signals 101 and 102 in digital signal processing section 100. Also, first and second mode switchover sections 800 and 900 are connectively switched over to the outputs for providing first and second switched signals 301 and 401 from first and second switching sections 300 and 400. Since the outputs of first and second mode switchover sections 800 and 900 are respectively connected to third and fourth amplifying sections, the digital audio signals (the stereo accompaniment music) read out from the video-song medium (shown in FIG. 2) are amplified by third and fourth amplifying sections 1000 and 1100 and are reproduced by audio output devices (not shown).

When the video-song mode is selected along with the analog mode by the user, the operation is as follows. Under the control of control section 1200, first and second switching sections 300 and 400 are connectively switched over to the outputs for providing first and second analog signals 201 and 202 in analog signal processing section 200. Also, first and second mode switchover sections 800 and 900 are connectively switched over to second amplified signal 701 and first amplified signal 601. When the user adjusts the adjusting knob of first and second variable resistors 510 and 520 included in audio multiplexing section 500 as shown in FIG. 3 in order to enhance the stereo accompaniment music, the resistance of second variable resistor 520 is adjusted to its minimum value while the resistance of first variable resistor 510 is adjusted to its maximum value. Here, first and second switched signals 301 and 401 from first and second switching sections 300 and 400 have their minimized audio levels and are connected to ground. On the other hand, first and second digital audio signals 101 and 102 from digital signal processing section 100 have their maximized audio levels with adjusting first variable resistor 510 and are amplified by first and second amplifying sections 600 and 700. When first and second amplified signals 601 and 701 are respectively applied to first and second mode switchover sections 800 and 900, first and second mode switchover sections 800 and 900 are switched over to the video-song mode. Accordingly, the first accompaniment music is amplified by third and fourth amplifying sections 1000 and 1100 and is reproduced by audio output device such as speaker.

Contrary to the aforementioned operation, when the user wants to enhance the second stereo accompaniment music that includes a singer's singing voice, the user adjusts the adjusting knob of first and second variable resistors 510 and 520 included in audio multiplexing section 500 so that the resistance of second variable resistor 520 is adjusted to its maximum value while the resistance of first variable resistor 510 is adjusted to its minimum value. Then, first and second digital audio signals 101 and 102 from digital signal processing section 100 have their minimized audio levels adjusted by first variable resistor 510 included in audio multiplexing section 500 and are bypassed to ground. On the other hand, first and second switched signals 301 and 401 from first and second switching sections 301 and 401 have their maximized audio levels adjusted by second variable resistor 520 and are amplified by first and second amplifying sections 600 and 700. When first and second amplified signals 601 and 701 are respectively applied to first and second mode switchover sections 800 and 900, first and second mode switchover sections 800 and 900 are switched over to the video-song mode. Accordingly, the second stereo accompaniment music that includes a singer's singing voice is amplified by third and fourth amplifying sections 1000 and 1100 and is reproduced by an audio output device, such as a speaker.

Embodiment 2

Figure 4:
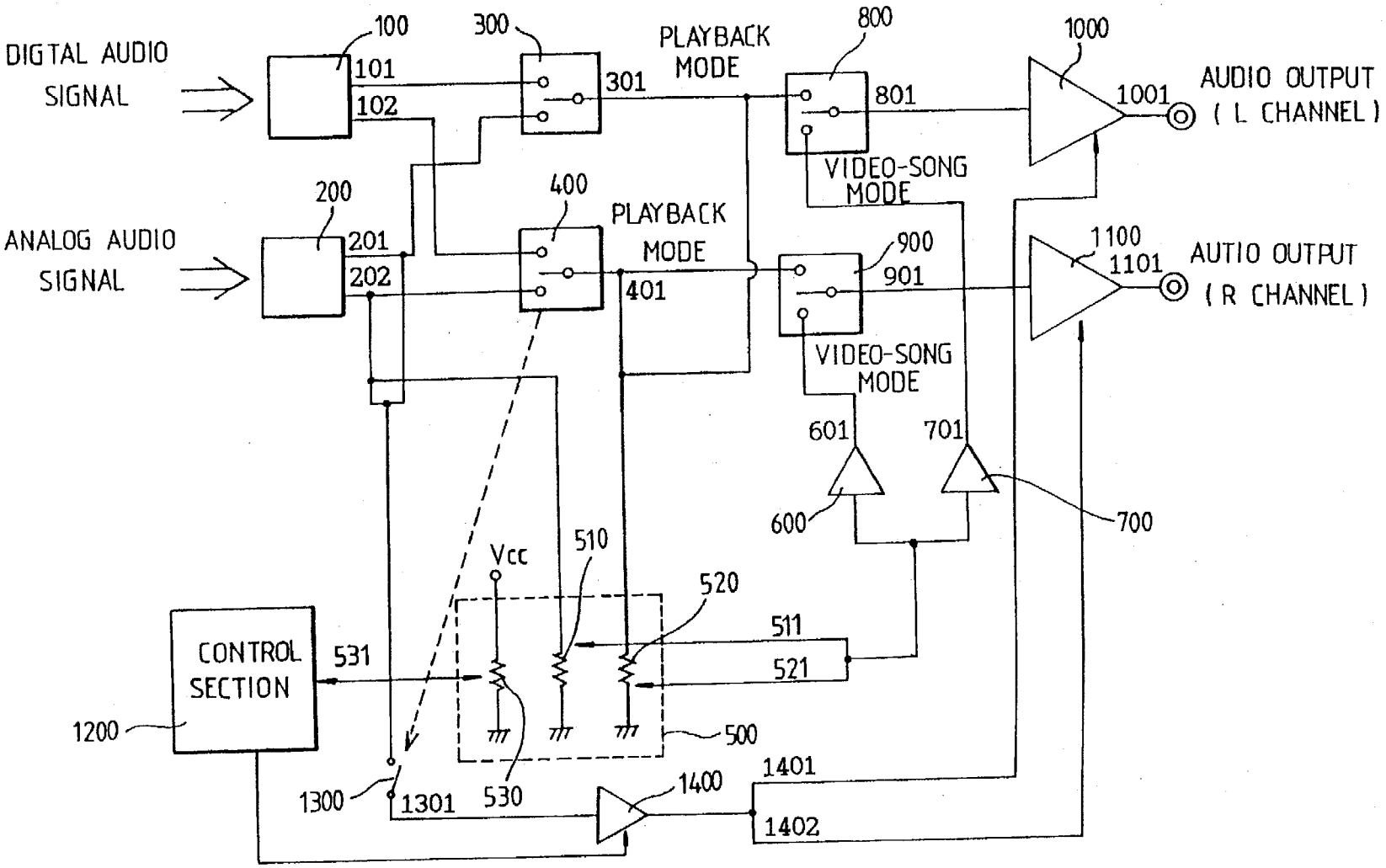
FIG. 4 is a block diagram for showing a configuration of the other embodiment of an apparatus for multiplexing audio signals in a video-song playback system for reproducing the video-song medium shown in FIG. 2.

FIG. 4 is a block diagram for showing a configuration of another embodiment of an apparatus for multiplexing audio signals in a video-song playback system for reproducing the video-song medium as shown in FIG. 2. As shown in the figure, the apparatus for multiplexing audio signals in a video-song playback system according to this embodiment of the present invention, includes a digital signal processing section 100. Digital signal processing section 100 decodes the first stereo accompaniment music which is read out from the L and the R channels included in the digital audio channels in the disc-shaped video-song medium shown in FIG. 2, into digital audio signals, and then outputs a first and a second digital audio signals 101 and 102 which respectively correspond to audio signals in the L and the R channels.

An analog signal processing section 200 decodes the second stereo accompaniment music that includes a singer's singing voice, which is read out from the L and the R channels included in the analog audio channels of the video-song medium, into analog audio signals, and then outputs a first and a second analog audio signals 201 and 202 which respectively correspond to audio signals in the L and the R channels.

A first switching section 300 switches over between first digital audio signal 101 from digital signal processing section 100 and first analog audio signal 201 from analog signal processing section 200. Consequently, first switching section 300 outputs a first switched signal 301 which corresponds either to first digital audio signal 101 or to first analog audio signal 201.

A second switching section 400 switches over between second digital audio signal 102 from digital signal processing section 100 and second analog audio signal 202 from analog signal processing section 200. Consequently, second switching section 400 outputs a second switched signal 401 which corresponds either to second digital audio signal 102 or to second analog audio signal 202.

An audio multiplexing section 500 adjusts voltage levels of first and second analog audio signals 201 and 202 from analog signal processing section 200 and first and second switched signals 301 and 401 respectively provided by first and second switching sections 300 and 400 in a digital mode and a video-song mode, and then outputs a first, a second and a third multiplexed signals 511, 521 and 531. Audio multiplexing section 500 includes a variable resistor which has a first, a second and a third variable resistors 510, 520 and 530 and an adjusting knob (not shown). The resistances of these resistors are adjusted in contrast to each other by a user. When a user establishes the digital mode and the video-song mode, first and second analog audio signals 201 and 202 from analog signal processing section 200 are applied to first variable resistor 510 and first and second switched signals 301 and 401 from first and second switching sections 300 and 400 are applied to second variable resistor 520 so that audio multiplexing section 500 adjusts signal levels of the first stereo accompaniment music and the second stereo accompaniment music that includes a singer's singing voice in proportion to the resistances of first and second variable resistors 510 and 520. Consequently, the audio levels of first and second analog audio signals 201 and 202 applied to first variable resistor 510 and the audio levels of first and second switched signals 301 and 401 applied to second variable resistor 520 are adjusted contrary to each other so that the first stereo accompaniment music and the second stereo accompaniment music including a singer's singing voice are selectively outputted (i.e., multiplexed). The position of a third movable tap in third variable resistor 530 is altered in connection with the position of a first movable tap in first variable resistor 510. Therefore, the resistance of third variable resistor 530 is changed in proportion to the resistance of first variable resistor 510.

A first and a second amplifying sections 600 and 700 respectively amplify first and second multiplexed signals 511 and 512 from audio multiplexing section 500, and then outputs a first and a second amplified signals 601 and 701.

In order to switch over between a normal playback mode and video-song mode, a first mode switchover section 800 switches over between first switched signal 301 from first switching section 300 and second amplified signal 701 from second amplifying section 700, and then outputs a first mode switchover signal 801. A second mode switchover section 900 switches over between second switched signal 401 from second switching section 400 and first amplified signal 601 from first amplifying section 600 in order to switch over between the normal playback mode and the video-song mode and outputs a second mode switchover signal 901. Namely, when the user connects a microphone (not shown) to the video-song playback system while establishing the video-song mode, first and second mode switchover sections 800 and 900 are automatically switched over to outputs of first and second amplifying sections 600 and 700 so that first and second audio multiplexed signals 511 and 521 are selectively outputted.

A third amplifying section 1000 amplifies first mode switchover signal 801 from first mode switchover section 800, and then outputs a third amplified sigal 1001.

A fourth amplifying section 1100 amplifies second mode switchover signal 901 from second mode switchover section 900, and then outputs a fourth amplified signal 1101.

A third switching section 1300 switches first and second analog signals 201 and 202 from analog signal processing section 200, and then outputs a third switched signal 1301.

A fifth amplifying section 1400 amplifies third switched signal 1301 from third switching section 1300 in order to output a fifth and a sixth amplified signals 1401 and 1402. The outputs for providing fifth and sixth amplified signals 1401 and 1402 are respectively connected to inputs of third and fourth amplifying section 1000 and 1100.

A control section 1200 senses whether a selected mode is the normal playback mode or the video-song mode and controls the switching operations of first and second switching sections 300 and 400 according to a selected mode and detects the voltage levels of first and second analog audio signals 201 and 202 which are adjusted by audio multiplexing section 500 in order to control fifth and sixth amplified signals 1401 and 1402 from fifth amplification section 1400. When control section 1200 senses the resistance of first variable resistor 510 adjusted to its maximum value by third variable resistor 530 included in audio multiplexing section 500, control section 1200 determines that audio multiplexing section 500 is set up for its audio multiplexing mode. Consequently, control section 1200 applies a control signal to fifth amplifying section 1400 and controls the audio levels of fifth and sixth amplified signals 1401 and 1402. Also, when the audio levels of first and second analog audio signals 201 and 202 are detected by third variable resistor 530, control section 1200 applies a control signal to fifth amplifying section 1400 so that the audio levels of fifth and sixth amplified signals 1401 and 1402 can be decreased.

Hereinafter, a description will be given to operations of the apparatus for multiplexing audio signals in a video-song playback system according to embodiment 2 of the present invention having the above-mentioned configuration.

When the digital mode or the analog mode is selected along with the normal playback mode by the user, the operation is as follows. Under the control of control section 1200, first and second switching sections 300 and 400 are connectively switched over to the outputs for providing first and second digital audio signals 101 and 102 in digital signal processing section 100 or first and second analog audio signals 201 and 202 in analog signal processing section 200. Also, first and second mode switchover sections 800 and 900 are connectively switched over to the outputs for providing first and second switched signals 301 and 401 in first and second switching sections 300 and 400. As the outputs of first and second mode switchover sections 800 and 900 are respectively connected to third and fourth amplifying sections, the digital audio signals (the stereo accompaniment music) read from the video-song medium (shown in FIG. 2) are amplified by third and fourth amplifying sections 1000 and 1100 and are reproduced by audio output devices (not shown).

When the video-song mode is selected along with the analog mode by the user, the operation is as follows. Under the control of control section 1200, first and second switching sections 300 and 400 are connectively switched over to the outputs for providing first and second digital signals 101 and 102 in digital signal processing section 100. Also, first and second mode switchover sections 800 and 900 are connectively switched over to first and second multiplexed signals 511 and 521. When in order to enhance the stereo accompaniment music the user adjusts the adjusting knob of first, second and third variable resistors 510, 520 and 530 included in audio multiplexing section 500 as shown in FIG. 4, the resistance of second variable resistor 520 is adjusted to its minimum value while the resistance of first variable resistor 510 is adjusted to its maximum value. Then, first and second switched signals 301 and 401 from first and second switching sections 300 and 400 have their minimized audio levels and are connected to ground. On the other hand, first and second analog audio signals 201 and 202 from analog signal processing section 200 have their maximized audio levels by adjusting first variable resistor 510 and are amplified by first and second amplifying sections 600 and 700. When first and second amplified signals 601 and 701 are respectively applied to first and second mode switchover sections 800 and 900, first and second mode switchover sections 800 and 900 are switched over for the video-song mode. Accordingly, the second accompaniment music including a singer's singing voice is amplified by third and fourth amplifying sections 1000 and 1100 and is reproduced by an audio output device such as a speaker.

Contrary to the aforementioned operation, when the user wants to enhance the stereo accompaniment music, the user adjusts the adjusting knob of first, second and third variable resistors 510, 520 and 530 included in audio multiplexing section 500 so that the resistance of second variable resistor 520 is adjusted to its maximum value while the resistance of first variable resistor 510 is adjusted to its minimum value. Then, first and second digital audio signals 101 and 102 from digital signal processing section 100 are applied to second variable resistor 520 via first and second switching sections 300 and 400. First and second analog audio signals 201 and 202 applied to first variable resistor 501 have its minimized resistance values adjusted by first variable resistor 501, and therefore are connected to ground. On the other hand, first and second switched signals 301 and 401 from first and second switching sections 301 and 401 have their maximized audio levels adjusted by second variable resistor 520 and are amplified by first and second amplifying sections 600 and 700. When first and second amplified signals 601 and 701 are respectively applied to first and second mode switchover sections 800 and 900, first and second mode switchover sections 800 and 900 are switched over for the video-song mode. Accordingly, the first stereo accompaniment music is amplified by third and fourth amplifying sections 1000 and 1100 and is outputted by an audio output device such as a speaker. At this time, control section 1200 detects the audio level of third multiplexed signal 531 from third variable resistor 530 and applies a control signal to fifth amplifying section 1400 so that the audio level of fifth amplified signal 1401 is decreased. Namely, in case that the audio level of the second stereo accompaniment music that includes a singer's singing voice is high, one can controllably decrease the audio levels of third and fourth amplified signals 1001 and 1101 from third and fourth amplifying sections 1000 and 1100.

According to the present invention, an apparatus is presented in a disc-shaped video-song medium which includes a plurality of digital audio channels that have the first stereo accompaniment music recorded therein, a plurality of analog channels that have the second stereo accompaniment music that includes a singer's singing voice recorded therein, and playback system thereof. The apparatus adjusts audio levels of the first stereo accompaniment music and the second stereo accompaniment music which includes a singer's singing voice to adequate audio levels by means of an audio level adjustment responsive to a change of resistances in the variable resistors included in an audio multiplexing section. The apparatus then multiplexes the audio signals. Accordingly, the user can effectively practice a video-song in harmony with the first stereo accompaniment music or the second stereo accompaniment music that includes a singer's singing voice.

It is understood that various other modifications will be apparent to and can be readily made by those skilled in the an without departing from the scope and spirit of this invention. Accordingly, it is not intended that the scope of the claims appended thereto be limited to the description as set forth herein, but rather that the claims be constructed as encompassing all the features of the patentable novelty that reside in the present invention, including all the features that would be treated as equivalents thereof by those skilled in the art to which this pertains.

What is claimed is:

1. An apparatus for multiplexing an audio signal in a video-song playback system, which comprises:

a digital signal processing section for processing a first stereo accompaniment music read out from an L and an R channels included in digital audio channels of the video-song medium, into digital audio signals, to output a first and a second digital audio signals, the video-song medium having both the digital audio channels with the first stereo accompaniment music recorded therein and analog audio channels with a second stereo accompaniment music that includes a singer's singing voice;

an analog signal processing section for processing the second stereo accompaniment music read out from the L and the R channels, included in the analog audio channels of the video-song medium, into analog audio signals, to output the first and the second analog audio signals;

a first switching section for switching over between the first digital audio signal from the digital signal processing section and the first analog audio signal from the analog signal processing section, to output a first switched signal;

a second switching section for switching over between the second digital audio signal from the digital signal processing section and the second analog audio signal from the analog signal processing section, to output a second switched signal;

an audio multiplexing section for adjusting audio levels of the first and second digital audio signals from the digital signal processing section, of the first switched signal from the first switching section and of the second switched signal from the second switching section in an analog mode and a video-song mode, to output a first and a second multiplexed signals;

first and second amplifying sections for amplifying the first and the second multiplexed signals, to output a first and a second amplified signals;

a first mode switching section for switching between the first switched signal from the first switching section and the first amplified signal from the first amplifying section in order to switch between a normal playback mode and a video-song mode, to output a first mode switched signal;

a second mode switching section for switching between the second switched signal from the second switching section and the second amplified signal from the second amplifying section in order to switch between the normal playback mode and the video-song mode, to output a second mode switched signal;

a third amplifying section for amplifying the first mode switched signal from the first mode switching section, to output a third amplified signal;

a fourth amplifying section for amplifying the second mode switched signal from the second mode switching section, to output a fourth amplified signal; and a control section for sensing whether a selected mode is the normal playback mode or the video-song mode, to control the first and the second switching sections and the first and the second mode switching sections.

2. The apparatus for multiplexing an audio signal in a video-song playback system as claimed in claim 1, wherein the audio multiplexing section includes a variable resistor that has a first and a second variable resistors therein, and one adjusting knob in which the resistances of the first and the second resistors are adjusted by a user in contrast to each other, the first and the second digital audio signals from the digital signal processing section are applied to the first variable resistor and the first and the second switched signals from the first and second switching sections are applied to the second variable resistor when the analog mode and the video-song mode are established so that the audio multiplexing section adjusts the signal levels of the first stereo accompaniment music and of the second stereo accompaniment music that includes a singer's singing voice in proportion to resistances of the first and the second variable resistors.

3. An apparatus for multiplexing an audio signal in a video-song playback system, which comprises:

a digital signal processing section for processing a first stereo accompaniment music read out from an L and an R channels included in digital audio channels of the video-song medium into digital audio signals to output first and second digital audio signals, the video-song medium having the digital audio channels with the first stereo accompaniment music recorded therein and analog audio channels with a second stereo accompaniment music that includes a singer's singing voice;

an analog signal processing section for processing the second stereo accompaniment music read out from the L and the R channels included in the analog audio channels of the video-song medium into analog audio signals, to output first and a second analog audio signals;

a first switching section for switching over between the first digital audio signal from the digital signal processing section, and the first analog audio signal from the analog signal processing section to output a first switched signal;

a second switching section for switching over between the second digital audio signal from the digital signal processing section and the second analog audio signal from the analog signal processing section, to output a second switched signal;

an audio multiplexing section for adjusting audio levels of the first and second digital audio signals from the digital signal processing section, the first switched signal from the first switching section and the second switched signal from the second switching section, in a digital mode and a video-song mode, to output a first, a second and a third multiplexed signals;

a first and a second amplifying sections for amplifying the first and the second multiplexed signals, to output respectively a first and a second amplified signals;

a first mode switchover section for switching over between the first switched signal from the first switching section and the second amplified signal from the second amplifying section in order to switch over between a normal playback mode and a video-song mode to output a first mode switchover signal, the first mode switchover section switching over from the normal playback mode to the video-song mode when a voice input device is connected to the video-song playback system in order to perform the video-song mode;

a second mode switchover section for switching over between the second switched signal from the second switching section and the first amplified signal from the first amplifying section in order to switch over between the normal playback mode and the video-song mode to output a second mode switchover signal, the second mode switchover section switching over from the normal playback mode to the video-song mode when a voice input device is connected to the video-song playback system in order to perform the video-song mode;

a third amplifying section for amplifying the first mode switchover signal from the first mode switchover section, to output a third amplified signal;

a fourth amplifying section for amplifying the second mode switchover signal from the second mode switchover section, to output a fourth amplified signal;

a third switching section for switching over the first and the second analog audio signals from the analog signal processing section, to output a third switched signal;

a fifth amplifying section for amplifying the third switched signal from the third switching section to output a fifth and a sixth amplified signals, the fifth amplifying section being connected to the third and the fourth amplifying section so that outputs of the fifth and the sixth amplified signals may be inputted to the third and the fourth amplifying sections; and a control section for sensing whether a selected mode is the normal playback mode or the video-song mode, to control a switching operation of the first and the second switching sections, and for detecting audio levels of the first and the second analog audio signals, which are adjusted by the audio multiplexing section and to control voltage levels of the fifth and the sixth amplified signals from the fifth amplifying section.

4. The apparatus for multiplexing an audio signal in a video-song playback system as claimed in claim 3, wherein the audio multiplexing section includes a variable resistor having a first, a second and a third variable resistors therein and an adjusting knob in which resistances are adjusted by a user in contrast to each other, the first and the second analog signals from the analog signal processing section are applied to the first variable resistor and the first and the second switched signals from the first and the second switching sections are applied to the second variable resistor so that the audio multiplexing section adjusts audio signal levels of both the first stereo accompaniment music and the second stereo accompaniment music that includes a singer's singing voice in proportion to the resistances of the first and the second variable resistors when the digital mode and the video-song mode are established.

5. The apparatus for multiplexing an audio signal in a video-song playback system as claimed in claim 4, wherein when the control section detects by the third multiplexed signal from the third variable resistor included in the audio multiplexing section, that the resistance of the first variable resistor is adjusted to its maximum value, the control section applies a control signal to the fifth amplifying section so that the audio levels of the fifth and the sixth amplified signals from the fifth amplifying section are decreased.

* * * * *